US011078892B2

(12) United States Patent
Jeong

(10) Patent No.: US 11,078,892 B2
(45) Date of Patent: Aug. 3, 2021

(54) ROTARY TYPE VALVE PLATE COMPRESSOR

(71) Applicants: HYUNDAI MOTOR COMPANY, Seoul (KR); KIA MOTORS CORPORATION, Seoul (KR)

(72) Inventor: Seong-Bin Jeong, Hwaseong-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 62 days.

(21) Appl. No.: 16/196,050

(22) Filed: Nov. 20, 2018

(65) Prior Publication Data

US 2020/0011307 A1 Jan. 9, 2020

(30) Foreign Application Priority Data

Jul. 3, 2018 (KR) ..... 10-2018-0077078

(51) Int. Cl.

| | |
|---|---|
| ***F04B 1/2021*** | (2020.01) |
| ***F04B 1/2078*** | (2020.01) |
| ***F04B 1/205*** | (2020.01) |
| ***F04B 27/10*** | (2006.01) |
| ***F04B 1/303*** | (2020.01) |

(52) U.S. Cl.

CPC ..... *F04B 1/2021* (2013.01); *F04B 1/205* (2013.01); *F04B 1/2078* (2013.01); *F04B 1/303* (2013.01); *F04B 27/1009* (2013.01); *F04B 27/1036* (2013.01)

(58) Field of Classification Search

CPC .. F04B 1/14; F04B 1/141; F04B 1/143; F04B 1/145; F04B 1/16; F04B 1/2021; F04B 1/205; F04B 1/2078; F04B 1/303; F04B 27/1036; F04B 27/1009; F04B 27/0839; F04B 1/2042

See application file for complete search history.

(56) References Cited

U.S. PATENT DOCUMENTS

| | | | | |
|---|---|---|---|---|
| 3,175,510 | A * | 3/1965 | Amato | F04B 1/2085 91/505 |
| 3,585,901 | A * | 6/1971 | Moon, Jr. | F04B 1/2021 91/6.5 |
| 5,807,080 | A | 9/1998 | Ochiai et al. | |
| 6,361,285 | B1 * | 3/2002 | Lehner | F04B 1/2042 417/269 |
| 2004/0228740 | A1 * | 11/2004 | Matsumoto | F01B 3/0032 417/269 |

FOREIGN PATENT DOCUMENTS

| | | | | |
|---|---|---|---|---|
| JP | H06-053777 | U | 7/1994 | |
| JP | 2000-161228 | A | 6/2000 | |
| KR | 10-2003-0006364 | A | 1/2003 | |
| KR | 10-2009-0031948 | A | 3/2009 | |
| KR | 10-2012-0008946 | A | 2/2012 | |
| WO | WO-2016202444 | A1 * | 12/2016 | F04B 27/0839 |

* cited by examiner

*Primary Examiner* — Nathan C Zollinger
(74) *Attorney, Agent, or Firm* — Brinks Gilson & Lione

(57) ABSTRACT

A rotary type valve plate compressor may include a shaft, a housing through which the shaft passes, a plurality of cylinders mounted in the housing, a piston received in the cylinder and to be moved forward and rearward in response to rotational operation of a swash plate, and a rotary type valve plate to receive a rotational force of the shaft and to open and close a refrigerant passage hole through which refrigerant passes, based on a phase of the piston.

10 Claims, 8 Drawing Sheets

FIG. 8 A "PRIOR ART"
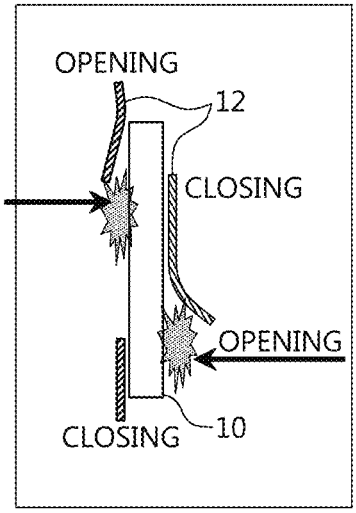
FIG. 8B "PRIOR ART"
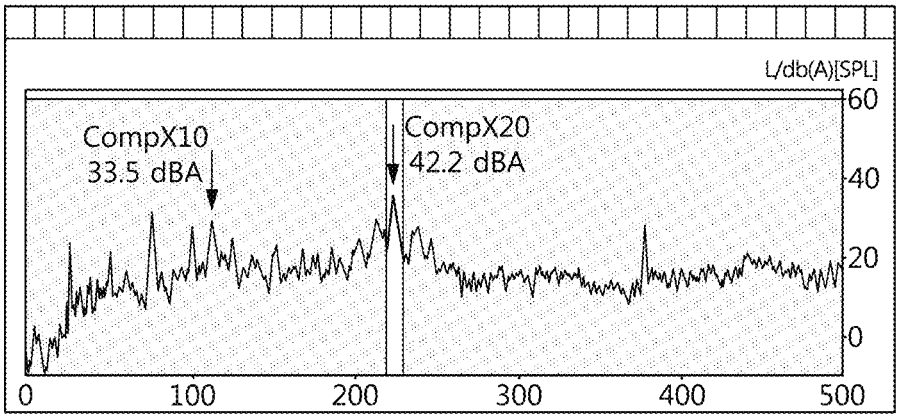

ROTARY TYPE VALVE PLATE COMPRESSOR

CROSS-REFERENCE TO RELATED APPLICATION

This application claims priority to and the benefit of Korean Patent Application No. 10-2018-0077078, filed on Jul. 3, 2018, the entire contents of which are incorporated herein by reference.

FIELD

The present disclosure relates to a rotary type valve plate compressor, and more particularly, to a rotary type valve plate compressor which can improve efficiency.

BACKGROUND

The statements in this section merely provide background information related to the present disclosure and may not constitute prior art.

Generally, an air conditioning apparatus mounted on a vehicle is provided for the purpose of maintaining the comfort of a passenger in the vehicle even when a temperature in the vehicle is increased like the summer reason. The air conditioning apparatus installed for this purpose generally utilizes the phenomenon in which liquid absorbs the surrounding heat when evaporated, and a dehumidifier and an air filter are also installed to remove the dust contained in indoor air.

In addition, the above-mentioned air conditioner includes a compressor for compressing refrigerant into a high-temperature and high-pressure gas state, an evaporator in which the refrigerant supplied from an expansion valve absorbs ambient heat to be evaporated, a condenser in which the heat absorbed in the evaporator is cooled and then discharged to the outside to liquefy the refrigerant, a reservoir for temporarily storing the refrigerant, which is liquefied by radiating heat in the condenser, without being directly flow into the expansion valve, and a blower for blowing air in a passenger compartment of a vehicle to the evaporator to be heat-exchanged and blowing cooled air into the passenger compartment.

Such the compressor in the air conditioning apparatus for a vehicle compresses refrigerant, which is discharged from the evaporator and is in a low-temperature low-pressure gas state, into refrigerant which is in a high-temperature high-pressure gas state, and is configured to discharge the refrigerant into the condenser. This compressor has a configuration in which a rotational movement of a swash plate is converted into a reciprocal movement of a piston to compress the refrigerant. Recently, an application of a variable control compressor has been expanded for several reasons such as an improvement of driving performance of a vehicle, maintenance of a uniform vent discharge temperature, an improvement of engine surge, an improvement of fuel efficiency caused by power reduction effect, etc. However, such a compressor is disadvantageous in that a configuration is complicated and cost of parts is thus increased.

A conventional compressor includes a low-pressure reed, a hole guide and a high-pressure reed, so that the reeds are opened and closed in a lift manner when suction and compression strokes of a piston are performed. However, we have discovered that since a controller is not provided for opening and closing the reed, for example, there is a problem that volumetric efficiency is lower as compared with volumetric efficiency of a scroll type compressor. In addition, such a compressor has a problem that when the reed is opened and closed, the reed strikes a valve plate and thus causes a booming noise.

SUMMARY

The present disclosure provides a rotary type valve plate compressor configured to inhibit or prevent an occurrence of booming noise caused by a compressor, and configured to open and close a refrigerant passage hole at a target compression ratio to improve volumetric efficiency.

According to one aspect of the present disclosure, a rotary type valve plate compressor may include a shaft; a housing through which the shaft passes; a plurality of cylinders mounted in the housing; a piston received in the cylinder and configured to be moved forward and rearward in response to rotational operation of a swash plate; and a rotary type valve plate configured to receive a rotational force of the shaft and to open and close a refrigerant passage hole through which refrigerant passes, according to a phase of the piston.

Here, the rotary type valve plate may suck, discharge and compress the refrigerant according to the phase of the piston.

Also, the rotary type valve plate may include a suction angle range in which low-pressure refrigerant is sucked, a discharge angle range in which high-pressure refrigerant is discharged, and a compression angle range in which the refrigerant is compressed.

Here, the refrigerant passage hole comprises a low-temperature low-pressure gas-suctioning hole through which low-temperature low-pressure gas is sucked and a high-temperature high-pressure gas-discharging hole through which high-temperature high-pressure gas is discharged.

In one form, the low-temperature low-pressure gas-suctioning hole may have an arc shape greater than that of the high-temperature high-pressure gas-discharging hole.

In addition, the high-temperature high-pressure gas-discharging hole may have a radius of curvature smaller than that of the low-temperature low-pressure gas-suctioning hole.

Here, the rotary type valve plate may have a configuration in which a rotational force-transmitting hole is formed in a central portion thereof and having a shape corresponding to that of the shaft.

The rotary type valve plate compressor may further include a hole guide and an end cover.

According to another aspect of the present disclosure, a rotary type valve compressor may include a shaft; a housing surrounding the shaft; a plurality of cylinders mounted in the housing; a piston received in corresponding cylinder of the plurality of cylinders and configured to be moved forward and rearward in response to rotational operation of a swash plate; and a rotary type valve plate configured to receive a rotational force of the shaft and to open and close a refrigerant passage hole through which refrigerant passes, according to a phase of the piston, wherein the refrigerant passage hole comprises a low-temperature low-pressure gas-suctioning hole through which low-temperature low-pressure gas is sucked and a high-temperature high-pressure gas-discharging hole through which high-temperature high-pressure gas is discharged, and wherein the low-temperature low-pressure gas-suctioning hole has a radius of curvature smaller than that of the high-temperature high-pressure gas-discharging hole.

According to one form of the present disclosure, the rotary type valve plate compressor may prevent an occurrence of booming noise thereof caused by striking the valve plate, and open and close the refrigerant passage hole at a target compression ratio to provide an effect of improving volumetric efficiency.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIGS. 8A and 8B respectively illustrate a schematic view and a graph showing a noise occurrence in a conventional compressor.

Figure 1:
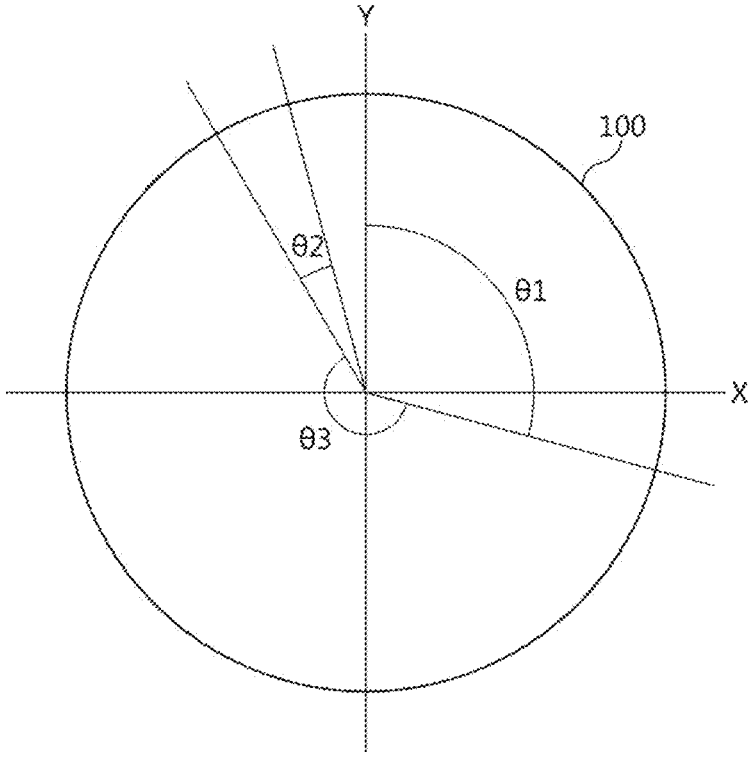
FIG. 1 is a schematic view showing a principle of a rotary type valve plate in one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The forms described below are provided so that those skilled in the art can easily understand the technical spirit of the present disclosure, and thus the present disclosure is not limited thereto. In addition, the matters illustrated in the accompanying drawings are schematized to easily describe the forms of the present disclosure, and thus may be different from those actually implemented.

It should be understood that when any component is referred to as being "connected" or "coupled" to another component, the component may be directly connected or coupled to another component, but any intervening component may be present between these components.

In addition, the term "connection" mentioned herein may include a direct connection and an indirect connection between one member and the other member and may refer to all physical connections such as gluing, attaching, fastening, joining, coupling, etc.

Furthermore, ordinal numbers such as "first," "second," etc. are employed merely for the purpose of distinguishing one component from another component, and do not limit the order or other features between configurations.

Unless the context clearly dictates otherwise, a singular expression includes a plural meaning. The "comprise" or "have" etc. specifies the presence of a feature, number, step, operation, component, element, or combination thereof described herein, and it may be understood that one or more other features, numbers, steps, operations, elements, parts, or combinations thereof may be added.

FIG. 1 is a schematic view showing a principle of a rotary type valve plate according to one form of the present disclosure.

Referring to FIG. 1, a rotary type valve plate 100 includes: a first portion corresponding to a first range of an angle θ1 in which low-pressure refrigerant is sucked, a second portion corresponding to a second range of an angle θ2 in which high-pressure refrigerant is discharged, and a third portion corresponding to a third range of an angle θ3 in which refrigerant is compressed.

According to one exemplary form of the present disclosure, the first range of the angle θ1 in which the low-pressure refrigerant is sucked is relatively larger than the second range of the angle θ2 in which the high-pressure refrigerant is discharged, and the third range of the angle θ3 in which the refrigerant is compressed is relatively larger than the first range of the angle θ1 in which the low-pressure refrigerant is sucked.

In addition, in another form, the first range of the angle θ1 in which the low-pressure refrigerant is sucked is formed to be spaced apart from the second range of the angle θ2 in which the high-pressure refrigerant is discharged.

In this configuration, a low-temperature low-pressure gas suctioning hole may be formed within the range of the angle θ1 in which the low-pressure refrigerant is sucked and a high-temperature and high-pressure gas discharging hole is formed within the range of the angle θ2 in which the high-pressure refrigerant is discharged.

Figure 2:
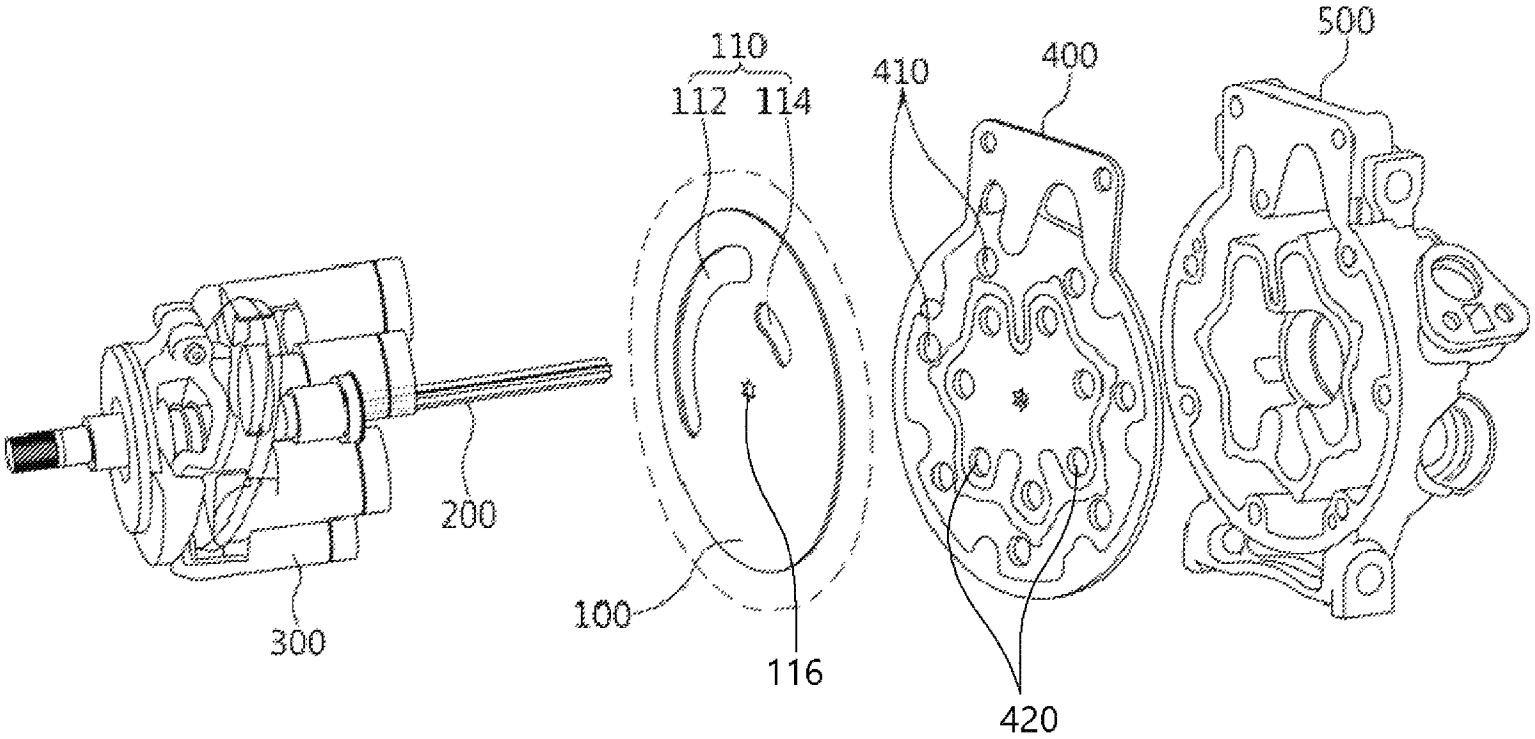
FIG. 2 is a schematic exploded perspective view of a rotary type valve plate compressor in one form of the present disclosure.
Figure 3:
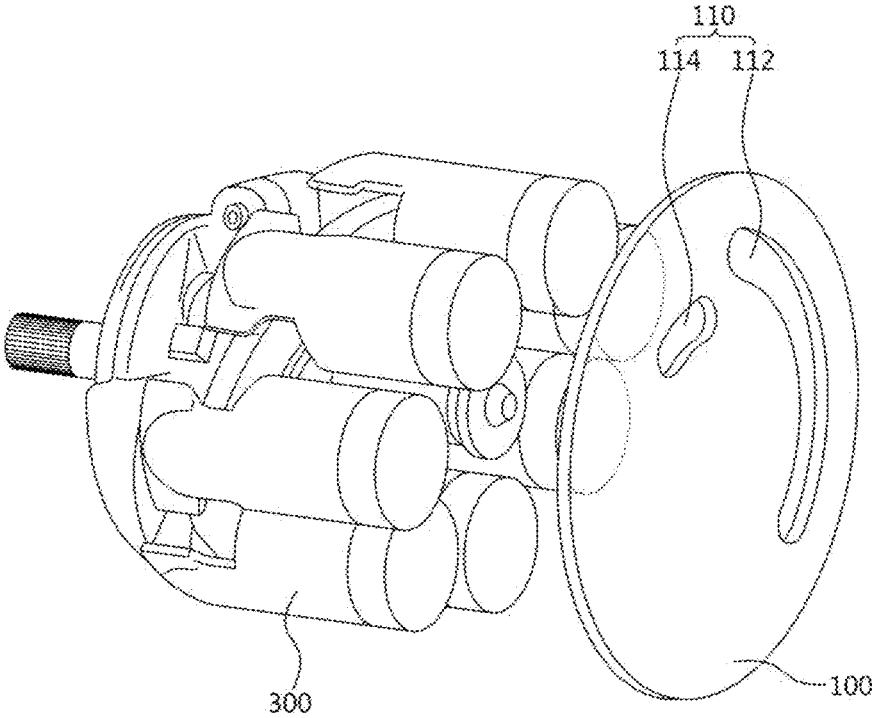
FIG. 3 is a schematic view of the rotary type valve plate compressor in one form of the present disclosure.

FIG. 2 is a schematic exploded perspective view of a rotary type valve plate compressor according to one form of the present disclosure, and FIG. 3 is a schematic view of the rotary type valve plate compressor according to one form of the present disclosure.

Referring to FIG. 2 together with FIG. 3, the rotary type valve plate compressor according to one form of the present disclosure includes a shaft 200, a housing through which the shaft 200 passes, a plurality of cylinders mounted in the housing, and a piston 300 received in the cylinder and configured to be moved forward and rearward in response to rotational operation of a swash plate. This compressor further includes the rotary type valve plate 100 that receives a rotational force of the shaft 200 and is configured to open and close a refrigerant passage hole 110 through which the refrigerant passes, according to a phase of the piston 300.

The rotary type valve plate 100 has a rotational force-transmitting hole 116 having a shape corresponding to that of the shaft 200 and formed at a central portion thereof, so that the rotational force of the shaft 200 is transmitted to the rotary type valve plate.

Further, the rotary type valve plate compressor further includes a hole guide 400 and an end cover 500.

Refrigerant-flowing holes 410, which are opened and closed by the rotary type valve plate 100, are formed in the hole guide 400. In one form, the refrigerant-flowing holes including outer and inner refrigerant-flowing holes 410, 420 are formed at regular intervals at different radial positions in which the outer refrigerant-flowing holes 410 are configured to communicate with the so that low-temperature low-pressure gas-suctioning hole 112 and the inner refrigerant-flowing holes 420 are configured to communicate with the high-temperature high-pressure gas-discharging hole 114.

Figure 4:
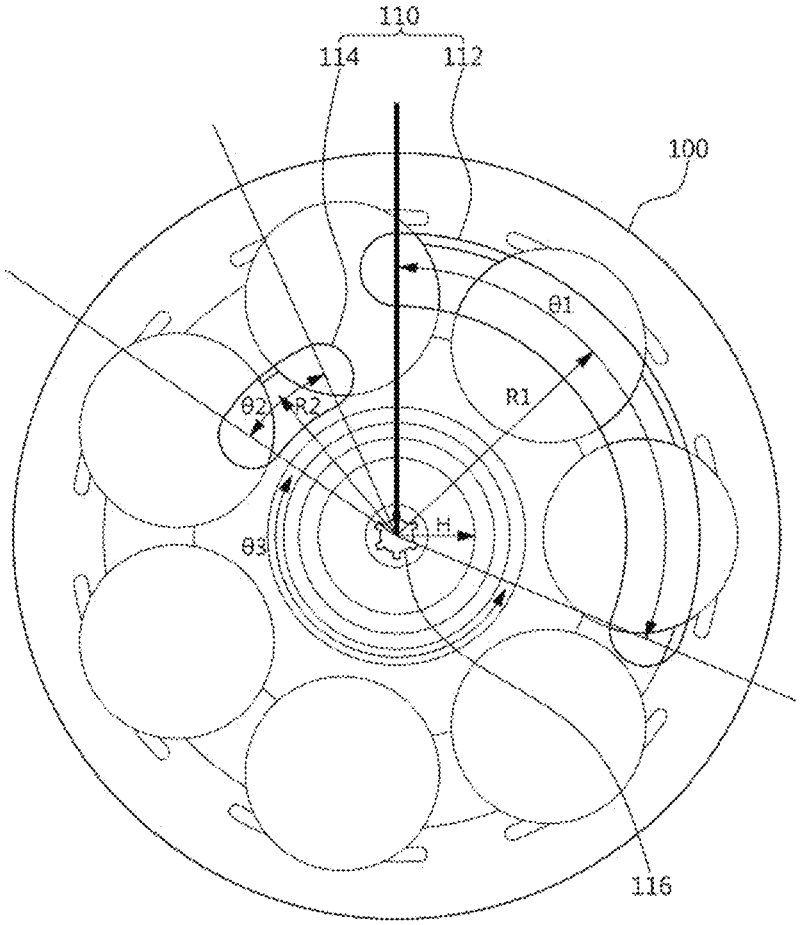
FIG. 4 is a schematic front view of the rotary type valve plate in the rotary type valve plate compressor in one form of the present disclosure.

FIG. 4 is a schematic front view of the rotary type valve plate in the rotary type valve plate compressor according to one form of the present disclosure.

Referring to FIG. 4, the rotary type valve plate 100 includes the suction angle θ1 at the low-pressure refrigerant is sucked, the discharge angle θ2 at which the high-pressure refrigerant is discharged, and the compression angle θ3 at which the refrigerant is compressed.

Further, the rotary type valve plate 100 has the refrigerant passage hole 110 formed therein, and the refrigerant passes through this the refrigerant passage hole. Here, the refrigerant passage hole 110 includes a low-temperature low-pressure gas-suctioning hole 112 through which low-temperature low-pressure gas is sucked and a high-temperature high-pressure gas-discharging hole 114 through which high-temperature high-pressure gas is discharged.

A radius of each of the low-temperature low-pressure gas-suctioning hole 112 and the high-temperature high-pressure gas-discharging hole 114 is positioned within a diameter range of the piston 300 when the rotary type valve plate 100 is rotated. In another form, the low-temperature low-pressure gas-suctioning hole 112 has an arc shape greater than that of the high-temperature high-pressure gas-discharging hole 114 and the high-temperature high-pressure gas-discharging hole 114 has a radius of curvature R2 smaller than a radius of curvature R1 of the low-temperature low-pressure gas-suctioning hole 112.

In addition, the rotary type valve plate 100 has a rotational force-transmitting hole 116 formed at a central portion thereof and having a shape corresponding to that of the shaft 200, and thus this rotational force-transmitting hole allows the rotational force of the shaft 200 to be transmitted to the rotary type valve plate.

Figure 5:
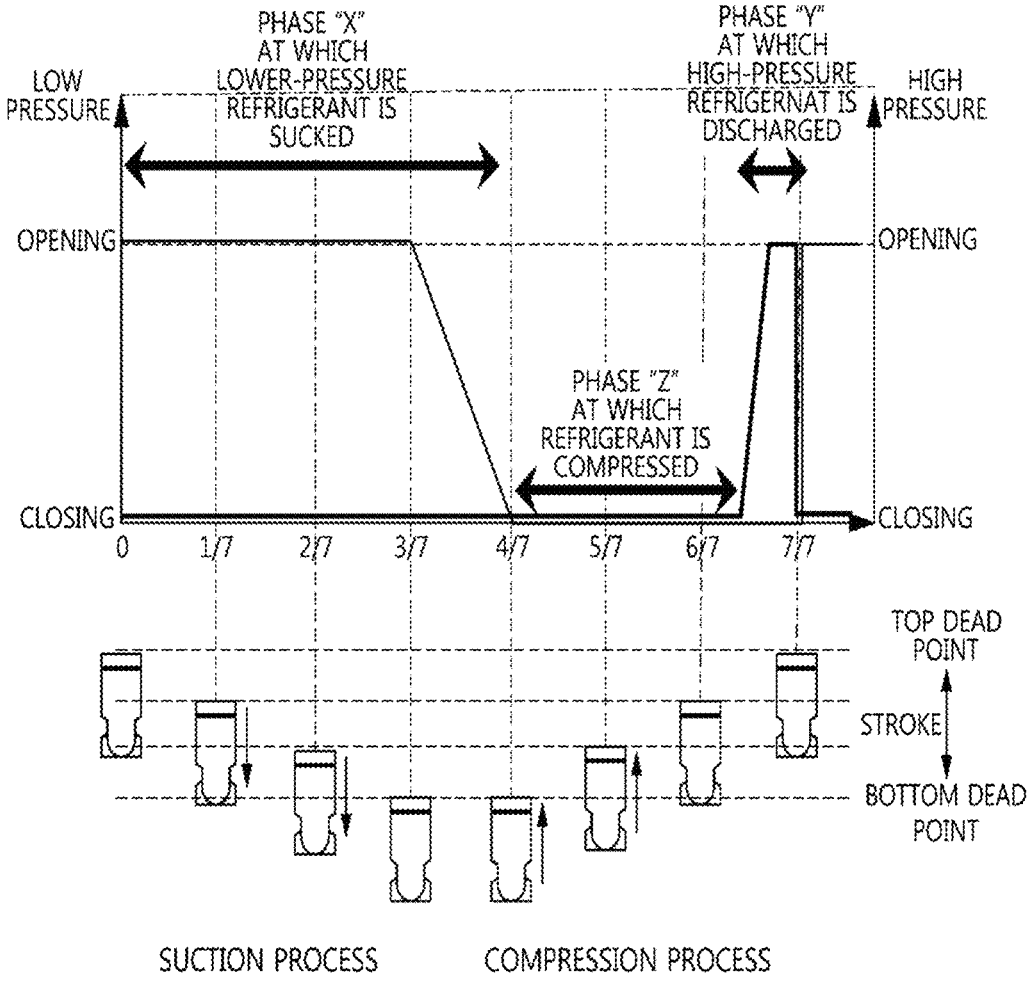
FIG. 5 is a schematic view showing an opening and closing of a refrigerant passage hole of the rotary type valve plate in the rotary type valve plate compressor in one form of the present disclosure.

FIG. 5 is a schematic view showing an opening and closing of a refrigerant passage hole of the rotary type valve plate in the rotary type valve plate compressor according to one form of the present disclosure.

Referring to FIG. 5 together with FIG. 4, the rotary type valve plate 100 includes the suction angle θ1 at which the low-pressure refrigerant is sucked, the discharge angle θ2 at which the high-pressure refrigerant is discharged, and the compression angle θ3 at which the refrigerant is compressed. Here, the suction angle θ1 at which the low-pressure refrigerant is sucked corresponds to a phase X at which the low-pressure refrigerant is sucked in a piston stroke, the compression angle θ3 at which the refrigerant is compressed corresponds to a phase Z at which the refrigerant is compressed in the piston stroke, and the discharge angle θ2 at which the high-pressure refrigerant is discharged corresponds to a phase Y at which the high-pressure refrigerant is discharged.

Meanwhile, the below Table shows opened and closed status of each of the low-temperature low-pressure gas-suctioning hole and the high-temperature high-pressure gas-discharging hole of the valve plate while the piston is moved from a top dead point to a bottom dead point.

TABLE

| | | | Status of Valve Plate | |
|---|---|---|---|---|
| Steps | Phase | Status of Piston | Low Pressure | High Pressure |
| Step 1 | 0/7 | Top dead point | Open | Open |
| Step 2 | 1/7 | Suction process | Open | Close |
| Step 3 | 2/7 | Suction process | Open | Close |
| Step 4 | 3/7 | Bottom dead point | Close | Close |
| Step 5 | 4/7 | Bottom dead point | Close | Close |
| Step 6 | 5/7 | Compression process | Close | Close |
| Step 7 | 6/7 | Compression process | Close | Open |

Referring to the Table, in a state in which the low-temperature low-pressure gas-suctioning hole and the high-temperature high-pressure gas-discharging hole of the valve plate are opened at the top dead point on 0/7 phase in the first step, when the piston is moved downward to the bottom dead center, the high-temperature high-pressure gas-discharging hole is closed, and the low-temperature low-pressure gas-suctioning hole and the high-temperature high-pressure gas-discharging hole are closed at the bottom dead center. Subsequently, the high-temperature high-pressure gas-discharge hole is opened in a compression process on 6/7 phase in the seventh step, and the above processes are repeated.

Figure 6:
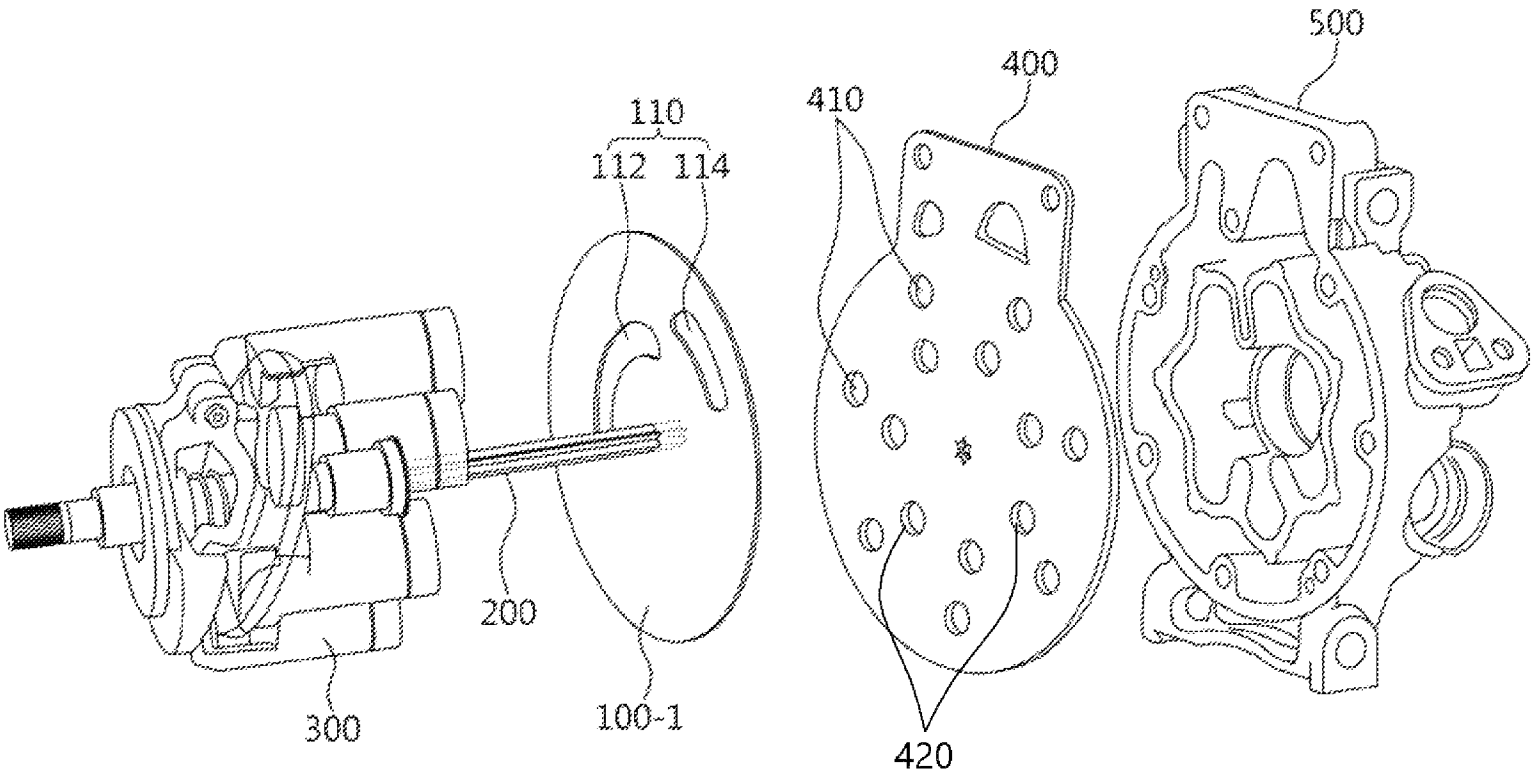
FIG. 6 is a schematic exploded perspective view of a rotary type valve plate compressor in another form of the present disclosure.
Figure 7:
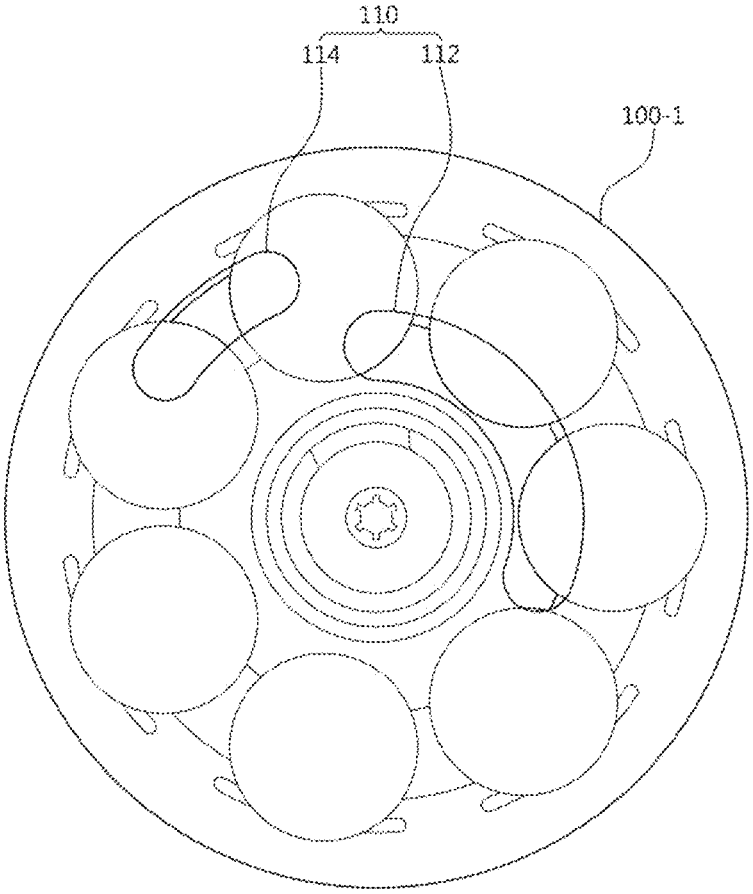
FIG. 7 is a schematic view of a rotary type valve plate in the rotary type valve plate compressor in another form of the present disclosure.

FIG. 6 is a schematic exploded perspective view of a rotary type valve plate compressor according to another form of the present disclosure, and FIG. 7 is a schematic view of a rotary type valve plate in the rotary type valve plate compressor according to another form of the present disclosure.

Referring to FIG. 6 together with FIG. 7, the rotary type valve plate compressor includes: the shaft 200, the housing through which the shaft 200 passes, the plurality of cylinders mounted in the housing, and the piston 300 received in the cylinder and configured to be moved forward and rearward in response to rotational operation of the swash plate. This compressor further includes a rotary type valve plate 100-1 that receives a rotational force of the shaft 200, and the rotary type valve plate is configured to allow the refrigerant passage hole 110 through which the refrigerant passes, to be opened and closed according to a phase of the piston 300. In addition, the rotary type valve plate compressor further includes the hole guide 400 including the outer and inner refrigerant-flowing holes 410, 420 and the end cover 500.

The refrigerant passage hole 100 includes the low-temperature low-pressure gas-suctioning hole 112 through which low-temperature low-pressure gas is sucked and the high-temperature high-pressure gas-discharging hole 114 through which high-temperature high-pressure gas is discharged. In addition, the hole guide 400 and the rotary type valve plate 100-1 are coupled to the shaft 200, and the end cover 500 is coupled to one side of the hole guide 400.

In this structure, the low-temperature low-pressure gas-suctioning hole 112 is configured to have a smaller radius of curvature than that of the high-temperature high-pressure gas discharging-hole 114.

FIGS. 8A and 8B are a schematic view and a graph showing a noise occurrence in a conventional compressor.

Referring to FIG. 8A, the conventional compressor has a drawback that high-pressure and low-pressure reeds 12 strike a valve plate 10 when opened and closed, thereby occurring booming noise.

This booming noise occurs at multiple frequency (Hz) corresponding to a revolution per minute (RPM) of the compressor. Referring to FIG. 8B, in the compressor having 5 cylinders, for example, the maximum noise of 33.5 dBA occurs at 10 multiple frequency and the maximum noise of 42.2 dBA occurs at 20 multiple frequency.

In addition, the conventional compressor is not provided with a controller for controlling the opening and closing of the reed 12, so that the reed 12 is mechanically opened and closed in accordance with the refrigerant pressure on the front and rear sides of the valve plate 10. As a result, the conventional compressor has a problem that volumetric efficiency is low.

Operation of the rotary type valve plate compressor according to one form of the present disclosure is described with reference to the drawings. The compressor including the shaft 200, the housing through which the shaft 200 passes, the plurality of cylinders mounted in the housing and the piston 300 received in the cylinder and configured to be moved forward and rearward in response to a rotation of the swash plate further includes the rotary type valve plate 100 that receives the rotational force of the shaft 200 to open and close the refrigerant passage hole 110 through which the refrigerant passes. Here, the refrigerant passage hole 110 through which refrigerant passes is formed in the rotary type valve plate 100.

According to the present disclosure, the refrigerant passage hole 110 includes the low-temperature low-pressure gas-suctioning hole 112 through which low-temperature low-pressure gas is suctioned and the high-temperature high-pressure gas-discharging hole 114 through which high-temperature high-pressure gas is discharged. As one form, in the compressor having seven cylinders and seven pistons 300, the rotary type valve plate 100 is rotated in response to the stroke of the piston 300, and as the rotary type valve plate 100 is rotated, the low-temperature low-pressure gas-suctioning hole 112 and the high-temperature high-pressure gas-discharging hole 114 are opened and closed. When the piston 300 is at the top dead point, the low-temperature low-pressure gas-suctioning hole 112 and the high-temperature high-pressure gas-discharging hole 114 are in an opened state, and when the piston 300 is moved downward to the bottom dead center, the refrigerant is sucked through the low-temperature low-pressure gas-suctioning hole 112. In addition, when the piston 300 reaches the bottom dead center, the low-temperature low-pressure gas-suctioning hole 112 and the high-temperature high-pressure gas-discharging hole 114 are in a closed state. Subsequently, when the piston 300 is moved upward from the bottom dead center to the top dead center, the refrigerant is compressed.

Therefore, the rotary type valve plate compressor according to the present disclosure prevents a booming noise occurrence thereof caused by striking the valve plate, and opens and closes the refrigerant passage hole at a target compression ratio to provide an effect of improving volumetric efficiency.

Those skilled in the art to which the present disclosure pertains will be able to understand that the present disclosure may be embodied in other specific forms without departing from the spirit or essential characteristics thereof. Therefore, the detail description is merely illustrative of the exemplary forms among various feasible examples of the present disclosure in order to facilitate the understanding of those skilled in the art, and the technical idea of the present disclosure is not limited to only by the forms described herein. In addition, various changes, additions and modifications may be made without departing from the technical spirit of the present disclosure, and other equivalent form thereof are also possible. The scope of the present disclosure is defined by the appended claims rather than the detailed description, and all changes or modifications derived from the meaning and scope of the claims and the equivalents thereof should be interpreted as being included in the scope of the present disclosure. Furthermore, the terms and words used in the specification and claims are defined in view of the fact that an inventor should appropriately define the concept of term in order to describe own disclosure in the best way, and should not be construed to be limited to ordinary or dictionary meanings. In addition, the order of the structures described in the above-described process does not necessarily need to be performed in a time series order, and it goes without saying that even although the order of execution of the respective constituents and steps is changed, if the changed order satisfies the gist of the present disclosure, it may belong the scope of the present disclosure.

What is claimed is:

1. A rotary type valve plate compressor, comprising;

a shaft;

a housing through which the shaft passes;

a plurality of cylinders mounted in the housing;

a piston received in each cylinder of the cylinders and configured to move forward and rearward in response to rotational operation of a swash plate;

a rotary type valve plate configured to receive a rotational force of the shaft and formed with a plurality of refrigerant passage holes through which refrigerant passes, wherein refrigerant passage holes of the plurality of refrigerant passage holes are selectively open or closed based on a phase of the piston;

a hole guide coupled to one side of the rotary type valve plate; and an end cover coupled to one side of the hole guide, wherein:

the refrigerant passage holes include: a low-temperature low-pressure gas-suctioning hole, and a high-temperature high-pressure gas-discharging hole which is disposed at a different radial position from the low-temperature low-pressure gas-suctioning hole, the low-temperature low-pressure gas-suctioning hole has an arc shape greater than an arc shape of the high-temperature high-pressure gas-discharging hole, a radius of curvature of the high-temperature high-pressure gas-discharging hole is different from a radius of curvature of the low-temperature low-pressure gas-suctioning hole, the hole guide includes a plurality of refrigerant-flowing holes formed at regular intervals at different radial positions which are opened and closed by the rotary type valve plate, and the plurality of refrigerant-flowing holes includes: outer refrigerant-flowing holes configured to communicate with the low-temperature low-pressure gas-suctioning hole, and inner refrigerant-flowing holes configured to communicate with the high-temperature high-pressure gas-suctioning hole.

2. The rotary type valve plate compressor of claim 1, wherein the rotary type valve plate sucks, discharges and compresses the refrigerant based on the phase of the piston.

3. The rotary type valve plate compressor of claim 2, wherein the rotary type valve plate comprises: a suction angle range in which low-pressure refrigerant is sucked, a discharge angle range in which high-pressure refrigerant is discharged, and a compression angle range in which the refrigerant is compressed.

4. The rotary type valve plate compressor of claim 1, wherein the radius curvature of the low-temperature low-pressure gas-suctioning hole is greater than the radius of curvature of the high-temperature high-pressure gas-discharging hole.

5. The rotary type valve plate compressor of claim 1, wherein the radius curvature of the high-temperature high-pressure gas-discharging hole is greater than the radius of curvature of the low-temperature low-pressure gas-suctioning hole.

6. The rotary type valve plate compressor of claim 1, wherein the rotary type valve plate has a rotational force-transmitting hole formed in a central portion thereof and having a shape corresponding to a shape of the shaft.

7. A rotary type valve plate compressor, comprising;

a shaft;

a housing surrounding the shaft;

a plurality of cylinders mounted in the housing;

a piston received in a corresponding cylinder of the plurality of cylinders and configured to be moved forward and rearward in response to rotational operation of a swash plate; and a rotary type valve plate configured to receive a rotational force of the shaft and formed with a plurality of refrigerant passage holes through which refrigerant passes, wherein refrigerant passage holes of the plurality of refrigerant passage holes are selectively open or closed based on a phase of the piston;

a hole guide coupled to one side of the rotary type valve plate; and an end cover coupled to one side of the hole guide, wherein the refrigerant passage holes comprise: a low-temperature low-pressure gas-suctioning hole through which low-temperature low-pressure gas is sucked, and a high-temperature high-pressure gas-discharging hole through which high-temperature high-pressure gas is discharged, wherein the high-temperature high-pressure gas-discharging hole is disposed at a different radial position from the low-temperature low-pressure gas-suctioning hole, wherein a radius of curvature of the low-temperature low-pressure gas-suctioning hole is smaller than a radius of curvature of the high-temperature high-pressure gas-discharging hole, wherein:

the hole guide includes a plurality of refrigerant-flowing holes formed at regular intervals at different radial positions which are opened and closed by the rotary type valve plate, and the plurality of refrigerant-flowing holes includes: outer refrigerant-flowing holes configured to communicate with the low-temperature low-pressure gas-suctioning hole, and inner refrigerant-flowing holes configured to communicate with the high-temperature high-pressure gas-suctioning hole.

8. The rotary type valve plate compressor of claim 7, wherein the rotary type valve plate includes a first angle range in which the low-temperature low-pressure gas is sucked, a second angle range in which the high-temperature high-pressure gas is discharged, and a third angle range in which gas is compressed.

9. The rotary type valve plate compressor of claim 8, wherein the first angle range is greater than the second angle range, and the third angle range is greater than the first angle range.

10. The rotary type valve plate compressor of claim 8, wherein the first angle range is formed to be spaced apart from the second angle range, and the third angle range is greater than the first angle range.

* * * * *